US005180321A

United States Patent [19]

Brown

[11] Patent Number: 5,180,321

[45] Date of Patent: Jan. 19, 1993

[54] SWIMMERS'S SAFETY BELT

[76] Inventor: Dennis Brown, 28 Bayonne Ave., Monmouth Beach, N.J. 07750

[21] Appl. No.: 771,109

[22] Filed: Oct. 4, 1991

[51] Int. Cl.[5] ..... B63C 9/16

[52] U.S. Cl. ..... 441/94; 441/108; 441/113

[58] Field of Search ..... 441/94, 108, 113, 106, 441/114, 115, 117, 119, 120, 122, 123

[56] References Cited

U.S. PATENT DOCUMENTS

| | | | |
|---|---|---|---|
| 3,263,249 | 8/1966 | Bryan | 441/94 |
| 3,302,224 | 2/1967 | Boucher | 441/94 |
| 4,626,221 | 12/1986 | Rocco | 441/113 |
| 4,810,219 | 3/1989 | Anderson et al. | 441/94 |

FOREIGN PATENT DOCUMENTS

| | | | |
|---|---|---|---|
| 1466562 | 3/1977 | United Kingdom | 441/94 |

*Primary Examiner*—Jesus D. Sotelo
*Assistant Examiner*—Stephen P. Avila
*Attorney, Agent, or Firm*—Charles I. Brodsky

[57] ABSTRACT

The belt of the invention is substantially hollow, and worn about the waist. The belt is able to be filled with a compressed gas from a cartridge coupled with it and puncturable by a pin whose placement is controlled by a pulling open of a belt buckle. A portion of the belt is adhesively secured in overlapping relationship, so as to unfold and expand outwardly under action of the compressed gas which fills it. The result is to increase the length of the belt when filled, thereby forming a tube riding under the armpits in holding a wearer vertically in the water, yet still allowing him or her to be able to swin about.

6 Claims, 1 Drawing Sheet

SWIMMERS'S SAFETY BELT

FIELD OF THE INVENTION

This invention relates to swimmer's safety belts, in general, and to a lighter, more streamlaned and more compact design then previously described, in particular.

BACKGROUND OF THE INVENTION

As is well known and understood, many devices have been described to be worn by a swimmer and to be inflatable by a compressed pressed gas cartridge of the swimmer were to encour in the water. As is also well known and understood, similar such devices have been described for use by a person who falls from a rowboat or canoe, for example. A myriad of devices have been described in the patent arts—many of them being of a fairly complex configuration and operation or bulky and unattractive design, which mitigates against their use on a production scale and precludes broad consumer interest. A need therefore exists for a construction which is simple in design and operation, and hence less likely to malfunction and much easier to deploy in use.

Additionally, analysis has shown that when these prior art preservers are designed in the nature of a "belt", yet another problem arises in that their designs either upend the user in the water, or cause such imbalance as to seriously incapacitate the swimmer. Even where this was not the situation, such prior conceived designs—even where they satisfactorily perform to stabilize the wearer in the water—exhibited serious limitations in not allowing the user to swim to safety. More specifically, such prior art constructions seem to be attached to the body in such a way that when the wearer attempted to assume a horizontal position in the water, he or she was prevented from swimming away because of the encumbering effect of the floatation device described.

OBJECTS OF THE INVENTION

Thus, it is an object of the invention not only to provide a swimmer's safety belt which is simple in design and operation, lighter, more streamlined and more competent in use, but one which will allow a user to swim to safety in a full range of swim strokes.

It is another object of the invention to provide such a design which is inexpensive to manufacture, to the extent that it could almost be produced as a throwaway item.

It is a further object of the invention to provide such a swimmer's safety belt which is more esthetically pleasing in appearance, and to be made available in a variety of colors and styles to appeal to fashion-conscious swimmers.

It is yet another object of the invention to provide such a design which can even be operated by a child, without requiring any involved or awkward steps for deployment.

It is a primary object of the invention, in all these configurations, to yet provide a safety belt which is free of the destabilizing features of those previously described versions known in the art.

SUMMARY OF THE INVENTION

As will be seen from the description that follows, the swimmer's safety belt of the invention ultimately assumes the shape of a life preserver in use, and allows the user to swim to safety using whatever swim strokes are most convenient. As will also be apparent, by assuming this shape, and in accordance with the invention, the safety belt even can be completely detached from the body to facilitate the swim action, holding onto the tubular belt as a conventional life preserver is held on to.

As will be seen, the belt of the invention is substantially hollow, and closable to fit the waist of a wearer. The belt will be seen to be thus fillable with a compressed gas from a cartridge coupled with it and puncturable by a pin whose placement is controlled by a pulling open of a belt buckle. In accordance with the invention, a portion of the belt is adhesively secured in overlapping relationship—as by a Velcro adhesive—so as to unfold and expand outwardly under action of the compressed gas which fills it. The result will be noted to be an increase in the length of the belt when filled, thereby forming a tube of diameter to accommodate the wider chest area of the swimmer, and to ride under the armpits in holding a wearer vertically in the water. As will be appreciated, and as will be more fully described below, the tube essentially forms a life preserver which then allows the wearer to swim about to safety. With the belt being made of a plastic composition—such as a rugged mylar-like material—the manufacturing costs of the belt can be kept quite low.

BRIEF DESCRIPTION OF THE DRAWINGS

These and other features of the present invention will be more clearly understood from a consideration of the following description, taken in connection with the accompanying drawings in which.

DETAILED DESCRIPTION OF THE DRAWINGS

Figure 1:
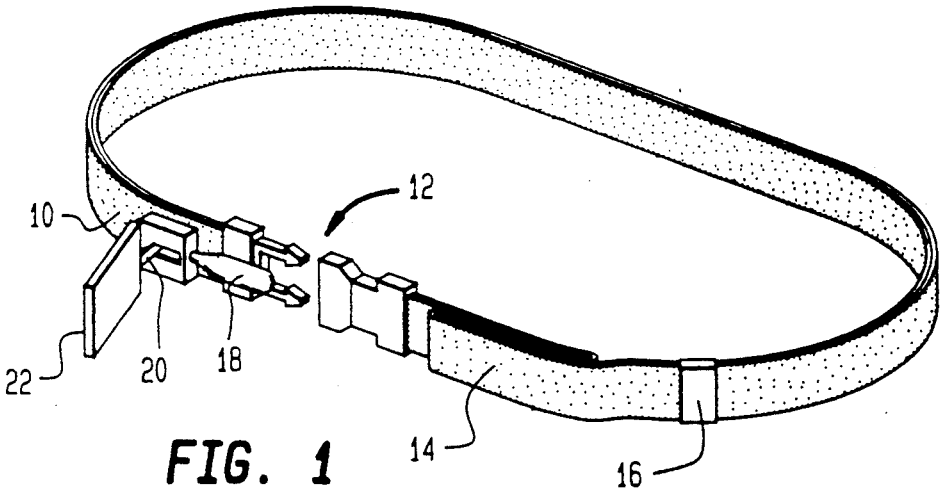
FIG. 1 schematically illustrates, in perspective view, a swimmer's safety belt constructed in accordance with the invention.
Figure 2:
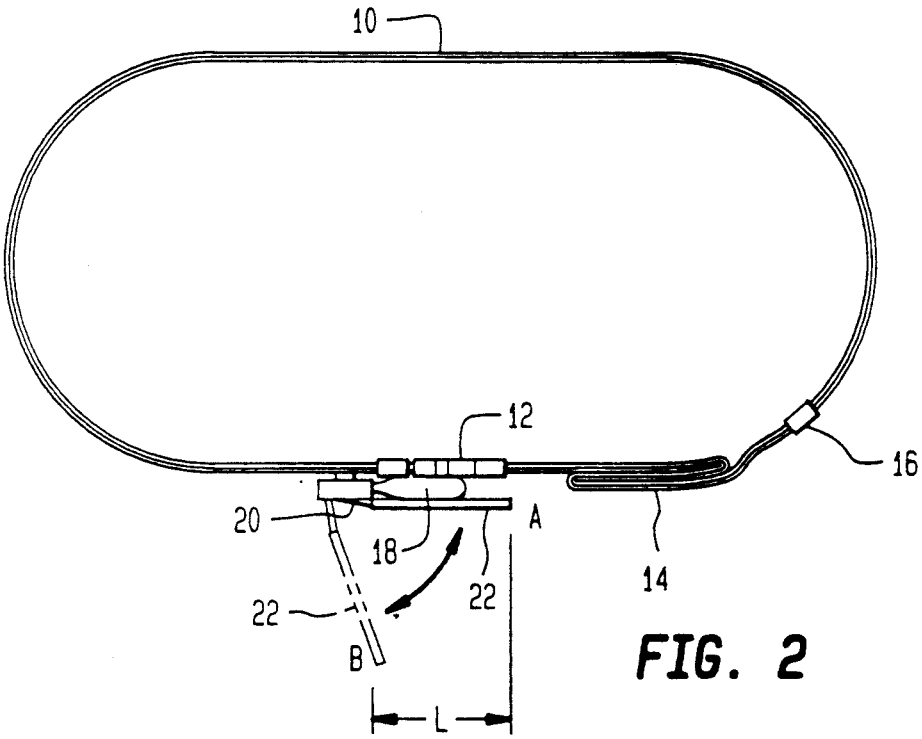
FIG. 2 is a top view helpful in an understanding of the invention.
Figure 3:
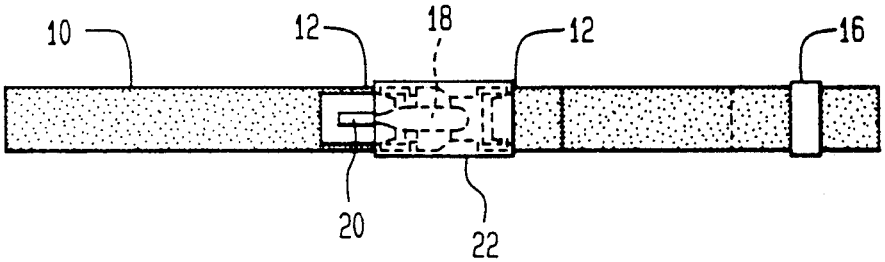
FIG. 3 is a front view of the belt comprising a preferred embodiment of the belt design.

Referring to FIGS. 1-3, the swimmer's safety belt of the invention incorporates a substantially hollow belt 10, constructed of a rugged mylar-like material or plastic composition and adjustable in length in any appropriate manner, and closable by any appropriate buckle or clasp 12. As will be particularly seen from FIG. 2, the belt 10 is provided with a folded, expandable portion 14—preferably adhesively secured in overlapping relationship, as by Velcro. Depending upon the clasp, or buckle, arrangement 12, a further clip 16 may be utilized, to adjust the size of the belt, i.e., the length of the belt encircling the waist of the wearer.

Also shown in the drawings, as by reference notation 18, is a compressed gas cartridge of a well known type, puncturable by a pin 20, movable with respect to such cartridge 18. As will be appreciated, the cartridge 18 is further coupled with the belt 10 so as to discharge its compressed gas when punctured, and so as to fill the belt 10 in the nature of a tube, similar to a life preserver. As illustrated, the pin 20 is actuated to movement by its connection to a buckle 22 which is shown as overlaying the clasp 12 and cartridge 18 when the buckle is shown in its closed position, as at A. In such arrangement, as will be seen, the buckle 22 then serves to cover the cartridge 18—and, if desired, a portion of the belt overlap 14—all as a function of the length L of the buckle 22. And, as so far described, as shown in FIG. 2, the belt of the invention may be worn by a swimmer, or simply as a safety belt by an occupant of a rowboat, canoe, sailboat, etc. As will be appreciated, in such utilization, the belt 10 is adjusted for comfort and size either by the clasp or buckle arrangement 12, or by the clip 16, and the compressed gas cartridge 18 continues to be sealed.

If the swimmer wearing such belt then finds himself or herself in difficulty in the water—or if the occupant of the rowboat , canoe, sailboat, etc. wearing such belt then inadvertently falls out into the water—the buckle 22 is to be then rotated to the position shown by the reference notation B. Such rotation of the buckle 22 will be seen to actuate the pin 20 connected with it, so as to puncture the cartridge 18, so as to then automatically fill the hollow belt 10 as a life preserver.

More importantly, however, the compressed gas will be appreciated to not only fill the belt 10, but will also act to unfold and expand outwardly the folded-over portion 14, previously secured by the Velcro, or other, adhesion. In response, the increased length of the belt which then results permits the belt to now be raised over the chest area to the wearer's arm level—and will be done automatically as the inflated belt rides up in the water. Depending upon the amount of the hollow belt initially overlapped at 14, the unfolding and outward expansion can be predetermined to allow the belt to ride under the armpits of the wearer, and to thereby hold the wearer substantially vertical in the water. In a preferred embodiment of the invention, the overlapping belt portion 14 was selected so that with a carbon dioxide compressed gas cartridge 18 of the type designated Heimsyphon 840AM, and manufactured by Roberts Valve Company, the length of the belt 10, when filled, increased by approximately 10 inches, to allow the belt to rise to the armpits of the wearer, from its initial position at the wearer's waist. A compressed gas cartridge of this type, puncturable by a pin actuator and with a cartridge which can be removably coupled and replaced after use is shown and described in U.S. No. 3,754,731.

As will thus be evident, all that is necessary in using the swimmer's safety belt of the invention is to put the belt on around the waist, clasp or buckle it, and adjust its length; if a need arises to inflate the belt in an emergency situation, all that is necessary is to pull, or rotate, outwardly the buckle 22, from its original position A, to its operative position B, and the belt 10 then fills automatically, with the folded-over portion 14 then unfolding and expanding. As will then be appreciated, the wearer could then swim about in this position, with the belt now at arm level, while wearing the belt of the invention now as a life preserver—or, alternatively, where the increased length of the belt becomes such that it can be traversed over the arms so as to be removed, will allow the wearer to swim using one hand, while holding onto the life preserver belt with the other hand. In either arrangement, it will be readily noted that the swimmer's safety belt is simple and expedient in its manufacture, wearing and use.

Additional features of the invention as described will be apparent. Thus, by having the belt 10 of a plastic type composition, it can be made available in a wide variety of colors and styles, and can be selected to coordinate with other clothing being worn. Because of such manufacture, the safety belt can be discarded after use, especially where an inexpensive compressed gas cartridge is employed; alternatively, where so desired, a more expensive cartridge arrangement might be selected, where the cartridge utilized can simply be discarded and replaced after use, thereby providing a swimmer's safety belt which can serve as a safety staple, available over-and-over again for repeated use. And, as will be easily understood, the method of operation—merely pulling open the buckle 22—is clearly recognizable even by a child, who can carry out such usage without any involved or awkward steps.

While there has been described what is considered to be a preferred embodiment of the invention, it will be readily appreciated by those skilled in the art that modifications can be made without departing from the scope of the teachings herein. Thus, whereas the compressed gas cartridge 18 is shown as being coupled to the belt 10 at a position adjacent to the folded-over portion 14, and within a space between the clasp or buckle arrangement 12 and the buckle 22, the cartridge 18, the activating pin 20 and the buckle 22 may be located anywhere along the belt 10, just so long as rotating the buckle 22 activates the pin 20 to puncture the cartridge 18 so as to fill the belt 10 with the compressed gas coupling into the hollow belt 10 from the cartridge. In like manner, as advances continue in the manufacture of compressed gas cartridges, versions of the present invention can also be foreseen where the cartridge 18 would, itself, become water activated, as by an accidental falling of the wearer from the rowboat, canoe, sailboat, etc. into the water, and to thus cause such activation to release the compressed gas in filling the substantially hollow belt 10. While admittedly not employing a buckle, as at 22, in activating the pin 20 to puncture the cartridge 18, such future alternatives would be appreciated by those skilled in the art to still fall within the scope of the present invention and its intendment of wearing the safety belt about the user's waist, and then automatically extending its length upon the release of the compressed gas during operation, so as to allow the life preserver so formed to rise up to the wearer's arm level. And, although the safety belt has been described as using a substantially hollow belt 10 of rugged mylar-like or plastic composition, it will be understood that all that is necessary is for the belt to be of a buoyancy to float in a water environment when filled with the compressed gas employed—no matter what manufacture is employed for the belt 10, and no matter whether the compressed gas is of a carbon dioxide, or other mixture. For at least such reasons, therefore, resort should be had to the claims appended hereto for a true understanding of the scope of the prevent invention.

I claim:

1. A swimmer's safety belt comprising:

a substantially hollow belt, closable to fit the waist of a wearer;

a compressed gas cartridge coupled with said belt;

a pin, movable to puncture said cartridge so as to allow said cartridge to fill said belt with compressed gas;

means, movable between first and second positions, to overlie said cartridge and said pin in said first position, for shielding said cartridge and said pin from view, and connected to said pin for moving said pin to puncture said cartridge when moved to said second position;

wherein a portion of said substantially hollow belt fitting the waist of a wearer is adhesively secured in folded, overlapping relationship so as to unfold and expand outwardly under action of the compressed gas which fills it when said means is moved to said second position to puncture said cartridge, thereby increasing the length of the belt in forming a tube to ride upwardly towards the arm level of the wearer;

wherein said means includes a decorative buckle overlying said cartridge and said pin in said first position and connected to said pin;

wherein said pin is movable to puncture said cartridge by pulling-open of said buckle to said second position;

wherein said belt is closable by a clasp to fit the waist of a wearer, and wherein said compressed gas cartridge is positioned between said clasp and said buckle which overlies said cartridge and said pin.

2. The safety belt of claim 1 wherein said compressed gas cartridge is removably coupled with said belt for replacement after use.

3. The safety belt of claim 1 wherein said portion of said belt in overlapping relationship is secured by a Velcro adhesive.

4. The safety belt of claim 1 wherein said portion of said belt in overlapping relationship unfolds under action of the compressed gas which fills it to increase the length of the belt of the order of 10 inches.

5. The safety belt of claim 1 wherein said cartridge is filled with a compressed gas of buoyancy to cause said belt to float in a water environment.

6. The safety belt of claim 1 wherein said substantially hollow belt is constructed of a plastic composition.

* * * * *